US010221618B2

(12) United States Patent
Pedersen et al.

(10) Patent No.: US 10,221,618 B2
(45) Date of Patent: Mar. 5, 2019

(54) CHILD SAFETY GATE

(71) Applicant: Baby Dan A/S, Lasby (DK)

(72) Inventors: Henrik Pedersen, Lasby (DK); Tina Moller-Nielsen, Lasby (DK)

(73) Assignee: Baby Dan A/S (DK)

( * ) Notice: Subject to any disclaimer, the term of this patent is extended or adjusted under 35 U.S.C. 154(b) by 177 days.

(21) Appl. No.: 15/267,301

(22) Filed: Sep. 16, 2016

(65) Prior Publication Data

US 2017/0002605 A1 Jan. 5, 2017

Related U.S. Application Data

(63) Continuation of application No. 14/361,008, filed as application No. PCT/DK2012/000124 on Nov. 26, 2012, now abandoned.

(30) Foreign Application Priority Data

Nov. 28, 2011 (DK) ..... 2011 00924

(51) Int. Cl.
*E06B 9/06* (2006.01)
*E05B 65/00* (2006.01)
(Continued)

(52) U.S. Cl.
CPC ..... *E06B 9/0607* (2013.01); *E05B 65/0014* (2013.01); *E06B 9/06* (2013.01);
(Continued)

(58) Field of Classification Search
CPC ..... E06B 9/06; E06B 9/0669; E06B 9/0638; E06B 11/022; E06B 2009/002;
(Continued)

(56) References Cited

U.S. PATENT DOCUMENTS 3,232,333 A 2/1966 Dixon
3,361,189 A 1/1968 Dixon
(Continued)

FOREIGN PATENT DOCUMENTS

GB 2448391 A 10/2008

OTHER PUBLICATIONS

International Search Report for PCT/DK2012/000124, dated Jul. 30, 2013, 3 pages.

(Continued)

*Primary Examiner* — Katherine W Mitchell
*Assistant Examiner* — Abe Massad
(74) *Attorney, Agent, or Firm* — Ware, Fressola, Maguire & Barber LLP

(57) ABSTRACT

The invention relates to a child safety gate which occupies as little space as possible when the gate is open. The child safety gate comprises two or more panels (1, 2, 3, 4) interconnected by at least one hinge (5). The panels are mounted in the opening via at least one fitting (10) connected with an end panel (3) at one side. At least one closure device (12, 13) is connected with an end panel (4) at the other side. The hinges (5) may be connected with the panels (1, 2, 3, 4), so that the panels may be folded inwardly over each other when the gate is opened. A panel top (8) and/or a panel base (9) may be connected with the panels. The panels (1, 2, 3, 4) may comprise two panel parts which may be telescoped. An extension panel may be disposed between the panel parts.

12 Claims, 8 Drawing Sheets

Figure 1:
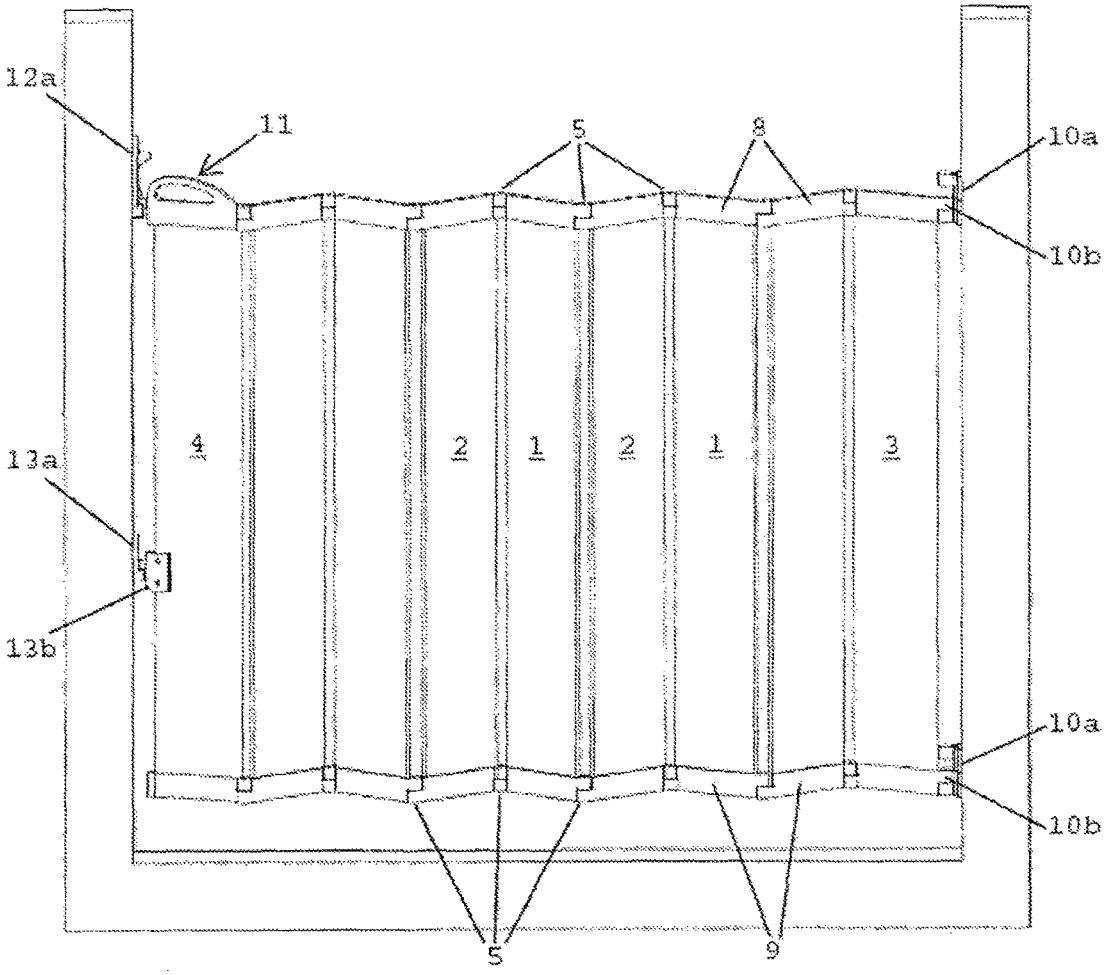

(51) Int. Cl.
*E06B 11/02* (2006.01)
*E06B 9/00* (2006.01)

(52) U.S. Cl.
CPC ..... *E06B 9/0638* (2013.01); *E06B 9/0669* (2013.01); *E06B 11/022* (2013.01); *E06B 2009/002* (2013.01)

(58) Field of Classification Search
CPC ..... E05B 65/0014; E05D 1/02; E05D 15/26; E05D 2015/268
See application file for complete search history.

(56) References Cited

U.S. PATENT DOCUMENTS 3,538,538 A 11/1970 Field
4,131,971 A 1/1979 Saarloos
4,157,413 A 6/1979 Ruhl
4,463,046 A 7/1984 Hutchison et al.
4,670,938 A 6/1987 Fowlston
4,828,132 A 5/1989 Francis, Jr. et al.
5,092,385 A * 3/1992 Beaulieu ..... A47G 5/00 160/135
5,097,883 A 3/1992 Robinson et al.
5,448,799 A 9/1995 Stein, Jr.
5,682,643 A * 11/1997 Duffy ..... E05D 3/12 16/225
6,053,591 A * 4/2000 Kasanic ..... A47B 47/0075 312/297
6,119,754 A 9/2000 Okonsky
6,123,321 A 9/2000 Miller
6,161,334 A 12/2000 Goodin
6,330,902 B1 * 12/2001 Chen ..... E06B 3/481 160/199
6,378,172 B1 * 4/2002 Schrage ..... E05D 3/12 16/225
6,510,589 B2 1/2003 Schrage
6,786,021 B1 * 9/2004 Chen ..... E06B 3/481 160/236
7,281,300 B2 * 10/2007 Andersen ..... E05D 3/02 16/254
7,673,923 B2 * 3/2010 Reese ..... B60J 1/06 296/84.1
2009/0044450 A1 2/2009 Hallman
2011/0175046 A1 7/2011 Flannery et al.

OTHER PUBLICATIONS

Danish Search Report for PA 2011 00924, dated Jul. 2, 2012, 1 page.

* cited by examiner

CHILD SAFETY GATE

TECHNICAL FIELD

The present invention relates to a child safety gate intended to be mounted in an opening, such as door openings or staircase openings, and comprising two or more panels which may be connected with each other, a mounting fitting intended to be mounted at one side of the opening, and a closure device intended to be mounted at the opposite side of the opening, wherein at least one of the panels is capable of rotating about a first axis of rotation in the mounting fitting.

THE PRIOR ART

Today, child safety gates are preferably constructed as rigid gate doors comprising an upper member and a lower member between which a plurality of vertical bars are mounted. These gate doors are mounted either directly on the wall or the frame in an opening or between one or two fixed gates. Frequently, these child safety gates have a post which is mounted directly on the wall, or a transverse member at the bottom.

U.S. Pat. No. 5,367,829 A describes a child safety gate mounted in an opening and comprising two gate sections which may be displaced relatively to each other, said gate being capable of rotating about a hinge at one side when the gate is opened. U.S. Pat. No. 5,657,809 A describes a child safety gate mounted in an opening and comprising a door with a pipe-shaped frame, which may be folded together when the gate is not to be used. When the gate is to be used, the frame is folded out and locked firmly, whereby the gate serves as a traditional rigid gate.

The known systems, however, have the drawback that they occupy a good deal of space around the opening in order to be able to open properly. Therefore, they are not useful around narrow openings or openings with a minimum of space. Moreover, the known child safety gates do not allow for skirting boards, floor mouldings, etc., which may be mounted in the openings.

WO 94/00664 A1 describes a child safety gate mounted in an opening and comprising a door constructed as a roller blind, which is secured at one end to two wall fittings, while the other end may be pulled past the opening and be secured to two ring-shaped hooks. This structure, however, may have the drawback that if the user releases the door after it has been opened, the door will perform an uncontrolled rolling-together at the opposite end because of the spring force. This may involve a potentially dangerous situation to the child and/or the pet.

US 2009/0044450 A1 describes a child safety gate disposed in a post housing, said gate comprising a plurality of panels mutually disposed between the panels via a plurality of hinges. In an embodiment, the child safety gate comprises a locking rod which may be placed across the top of the panels, whereby the panels form a rigid gate. Since the panels are concealed inside the post housing, the post housing will occupy a good deal of space in the opening, whereby the child safety gate will only be suitable for staircase openings where a handrail post is normally arranged. Moreover, the panels are vulnerable to external blows and impacts if the locking rod is not used. Furthermore, the panels are connected to each other only pointwise, whereby children and/or pets may have their fingers/paws caught between the panels if the locking rod is not used.

This invention provides an alternative child safety gate which occupies as little space as possible when the gate is open.

THE OBJECT OF THE INVENTION

The present invention remedies the problems of the most immediate prior art by providing a child safety gate characterized in that at least two of the panels may be connected with each other either via one or more gripping parts disposed on the one panel intended to engage one or more receiving parts disposed on the other panel or via one or more hinges extending along the entire edge of the panel. This provides a child safety gate which may be mounted in or near the opening independently of any skirting boards, floor mouldings and the like. Hereby, it is possible to provide a child safety gate which partly takes up as little space as possible when the gate is open, and partly is easy and rapid to assemble.

At least one of the panels comprises two panel parts, where the gripping part is arranged on the one panel part, and the receiving part is arranged on the other panel part. The one panel part in one panel may be connected with another panel part in another panel via a hinge. In a special embodiment, the child safety gate comprises a first end panel which may be connected with the fitting, a second end panel which may be connected with the closure device, wherein at least the one panel part is an end panel comprising a finishing edge which may face toward the fitting or the closure device. Hereby, it is possible to assemble the individual panels by pushing them in an easy and rapid manner, and wherein the individual panels may be folded inwardly over each other.

The two panel parts, which form at least one of the panels, may be joined with a rigid joint, so that, in principle, they serve as a plate. In an alternative embodiment, the two panel parts may be joined with a hinge so that they may be moved relative to each other. Both when the panel parts are joined with a rigid joint or with hinges, there are embodiments where the two panel parts may be separated from each other and subsequently be put together again.

The child safety gate comprises one or more extension panels, wherein the gripping part and the receiving part are disposed on their respective edges so that the extension panels may be disposed between the panel parts and/or the end panels. In an embodiment, the gripping part and the receiving part are configured such that a panel and an extension panel may be inserted into each other in that the gripping part and the receiving part may be inserted into each other in the longitudinal direction of the panels. This provides a simple manner of joining the panels and the extension panels with each other, and several extension panels may be joined and inserted between two panels, or several extension panels may be inserted between several panels, e.g. so that a row of panels and extension panels joined alternately is produced. In this manner, the length of the child safety gate may easily be adapted to e.g. a door opening.

In a special embodiment, the child safety gate comprises a first end panel which may be connected with the fitting, a second end panel which may be connected with the closure device, wherein a plurality of extension panels, which may be connected with each other, may be disposed between the end panels. Hereby, it is possible to adapt the width of one or more panels and the entire child safety gate by introducing one or more extension panels. Moreover, it is possible to join the panels so that they form one complete rigid child safety gate.

At least one of the panels comprises a panel top and/or a panel base, or is connected with a panel top and/or a panel base. Hereby, it is possible to protect and reinforce the ends of the panel against external blows and impacts.

In a special embodiment, the panel top and/or the panel base comprises an insertion part intended to engage a receiving part disposed on another panel top and/or the panel base.

The insertion part may be disposed in extension of the panel part or the panel and the receiving part at the side of the insertion part, wherein the insertion part may face away from the panel part or the panel, while the opening of the receiving part may face toward the panel part or the panel. The insertion part comprises a locking device which may engage the receiving part, said locking device comprising a release mechanism. Hereby, the panel base and the panel top will appear as one complete unit when the panel parts are joined. Moreover, it is possible to adapt the width of the panel top and the panel base to the width of the panels when one or more extension panels are inserted. Likewise, it is possible to secure the panels to each other when the child safety gate is in use.

In an embodiment, the hinge is a flexible hinge, e.g. a flexible profile or membrane, extruded or embedded in the panel parts and/or panels. The panel parts and the hinge disposed between these are extruded or moulded together in one piece, or at least two of the panels and the hinges disposed between these are extruded or moulded together in one piece. In an alternative embodiment, the hinge is a flexible hinge, e.g. a flexible profile or membrane, comprising two thickened ends, and the panel parts and/or the panels comprise a groove or a crack in which the thickened ends of the hinge may be arranged. Hereby, it is possible to produce a child safety gate which may be joined easily and rapidly in the desired width and which is also simple and inexpensive to produce. Further, the panels are automatically folded inwardly over each other when the child safety gate is opened.

In a second embodiment , the hinge is a rotating hinge comprising two hinge parts capable of rotating about a second axis of rotation in the hinge, said hinge comprising a spring, e.g. a torsional spring. A rotating hinge is disposed between the panel tops and/or the panel bases, and a flexible hinge is disposed between the panels and/or the panel parts. Hereby, it will be possible to provide a child safety gate which rotates about each other, and wherein the panels are automatically folded inwardly over each other when the child safety gate is opened The gripping part is configured as a pin optionally with a head or an elevation, and the receiving part is configured as a second groove or a depression in which the pin may be arranged. The gripping part is configured as a pin, and the receiving part is configured as a pin hole in which the pin may be arranged, and the pin and the pin hole are disposed opposite each other on the inner side of the panel parts. Hereby, it is possible to join the individual panel parts in an easy and simple manner.

In a special embodiment, the mounting fitting comprises a wall part intended to be mounted in the opening and a panel part connected with the first end panel, said panel part being capable of rotating about the wall part. The wall part comprises a first central member connected with the two first end members, said first central member comprising a third groove, e.g. a cylinder section, in which the panel part may be disposed. The panel part comprises a second central member connected with two second end members, said second central member and said two second end members being cylindrical. Hereby, it is possible to provide a fitting which significantly reduces the risk of children and/or pets getting their fingers/paws caught in the fitting when the child safety gate is opened or closed.

The second central member comprises two parallel sides which face away from the wall part, and each of the two second end members comprises a U-shaped side disposed in extension of the two parallel sides on the second central member, between which the first end panel may be disposed. The first end panel may be connected with the panel top and/or the panel base, which comprises a guide arrangement, whereby the first end panel may be moved into or out of the panel part, said two second end members comprising a locking mechanism which is capable of holding the guide arrangement in a given position. Hereby, it is possible to provide a fitting suitable for oblique/inclined openings, where the position of the end panel relative to the fitting may be adjusted individually at the top and the base, thereby achieving correct mounting. Moreover, it is possible to ensure that children and/or pets cannot get their fingers/paws caught between the end panel and the fitting.

In a special embodiment, the closure device comprises a safety mechanism or a locking device intended to hold the second end panel to a wall part when the child safety gate is closed, said safety mechanism or said locking device comprising a release device which has to be activated in order to open the child safety gate. The closure device comprises a housing with an elongated depression in which the second end panel may be disposed when the child safety gate is closed. Hereby, it is possible to provide a closure device, where children and/or pets cannot get their fingers/paws caught between the end panel and the closure device.

Figure 2:
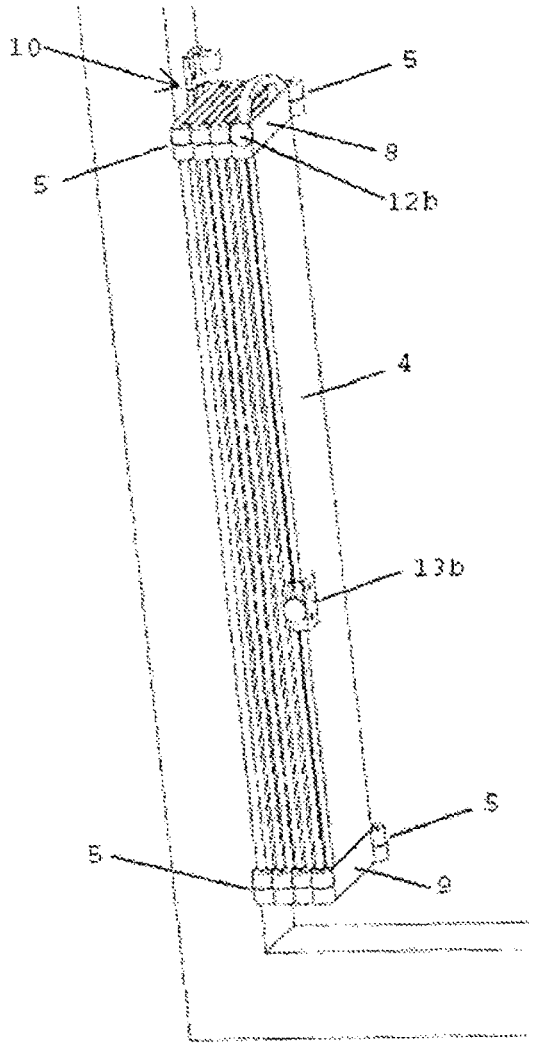
Figure 3:
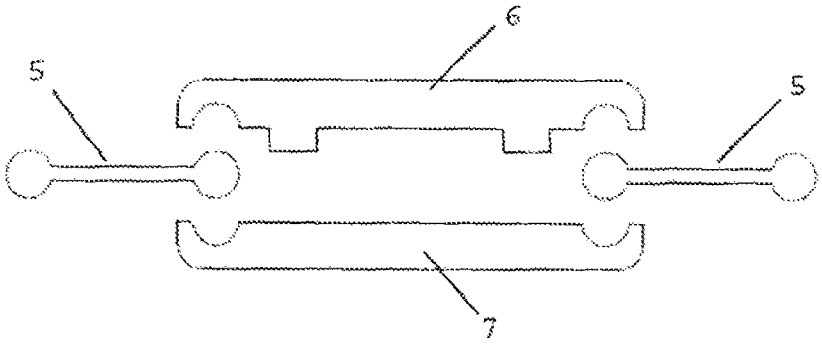
Figure 4:
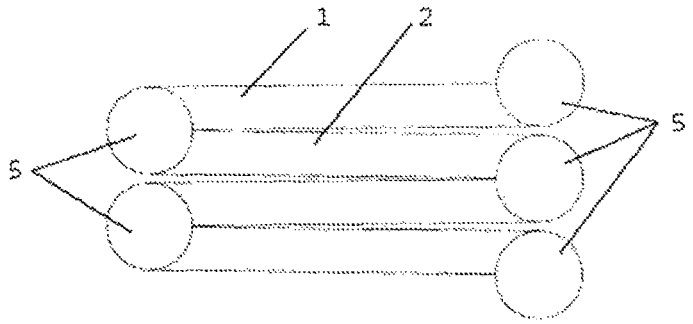
Figure 5:
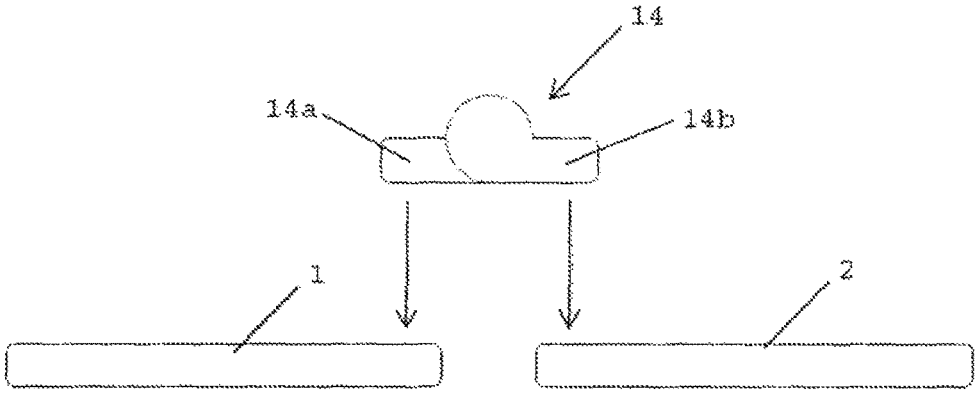
Figure 6:
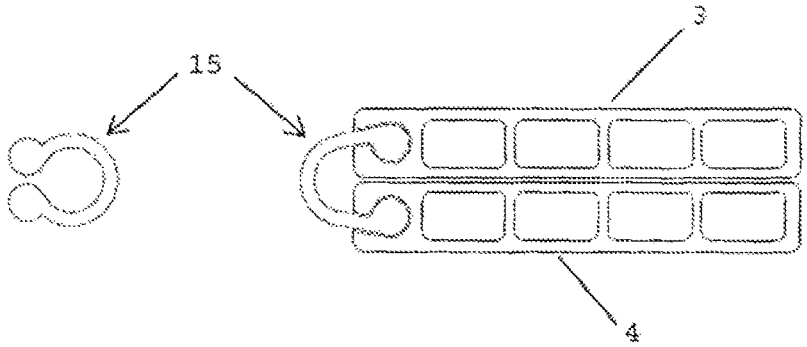
Figure 7:
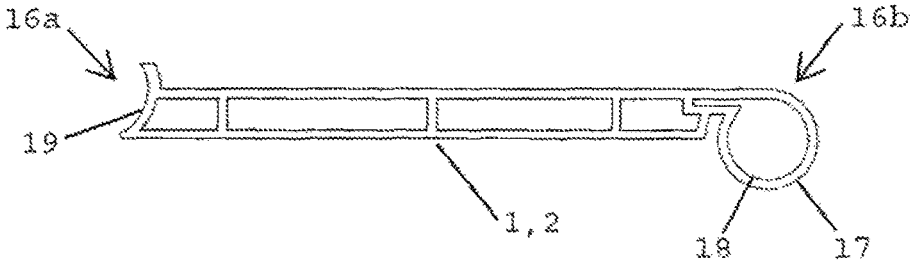
Figure 8:
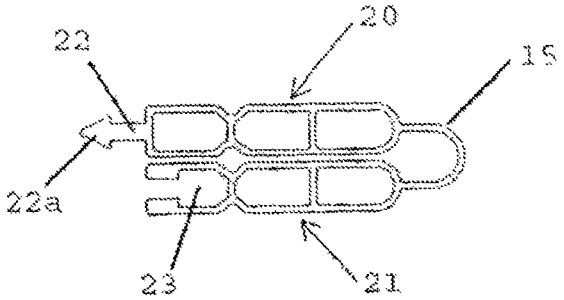
Figure 9:
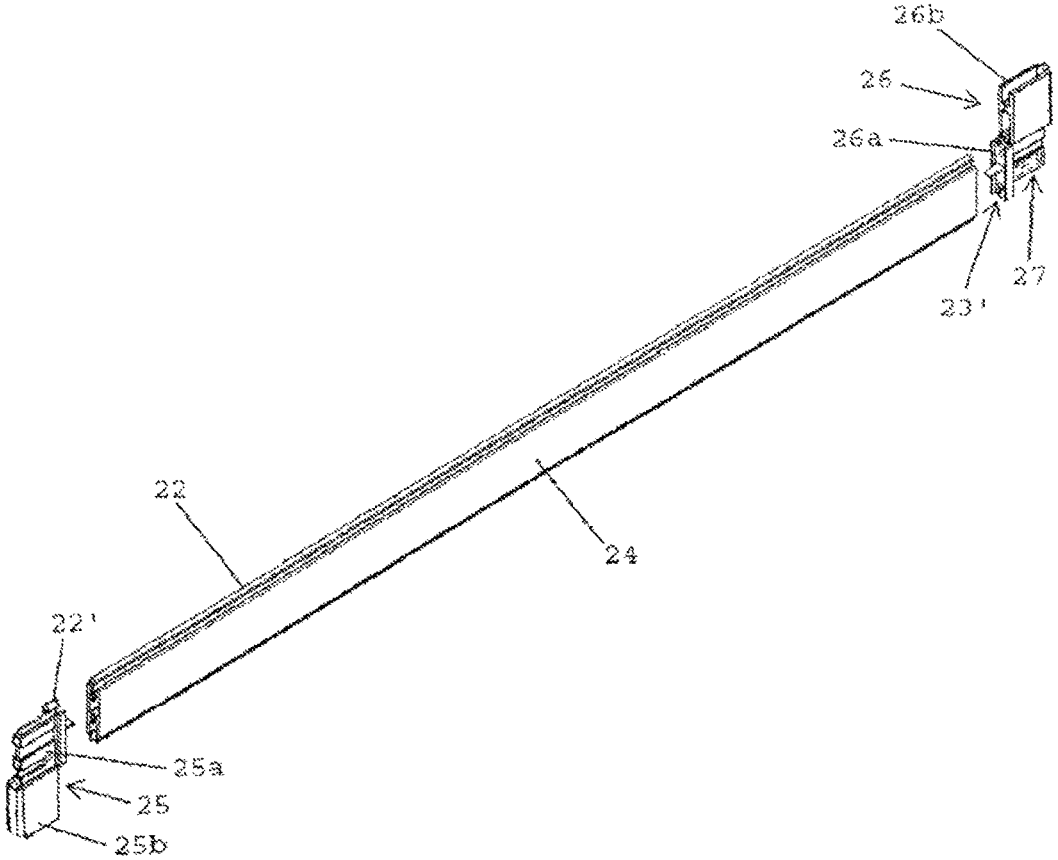
Figure 10:
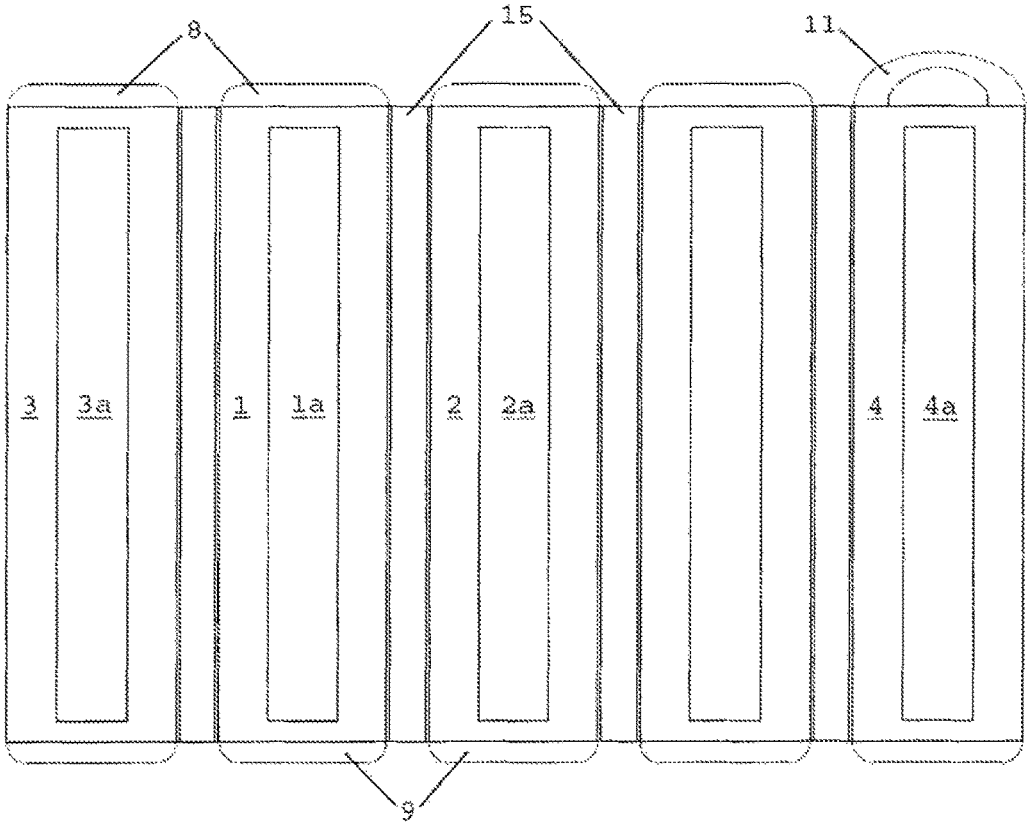
Figure 11:
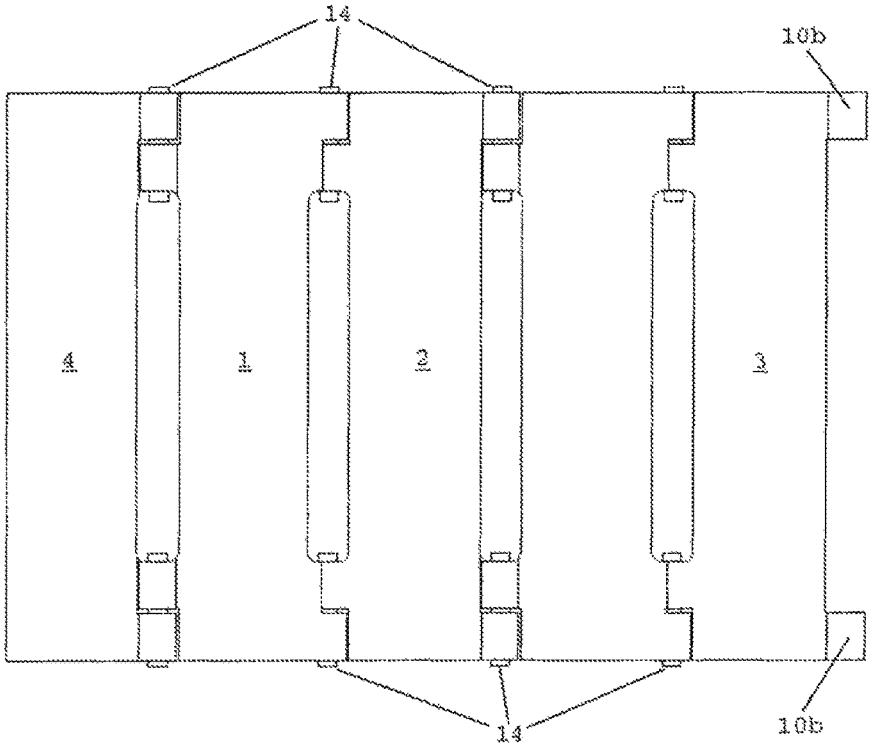
Figure 12A:
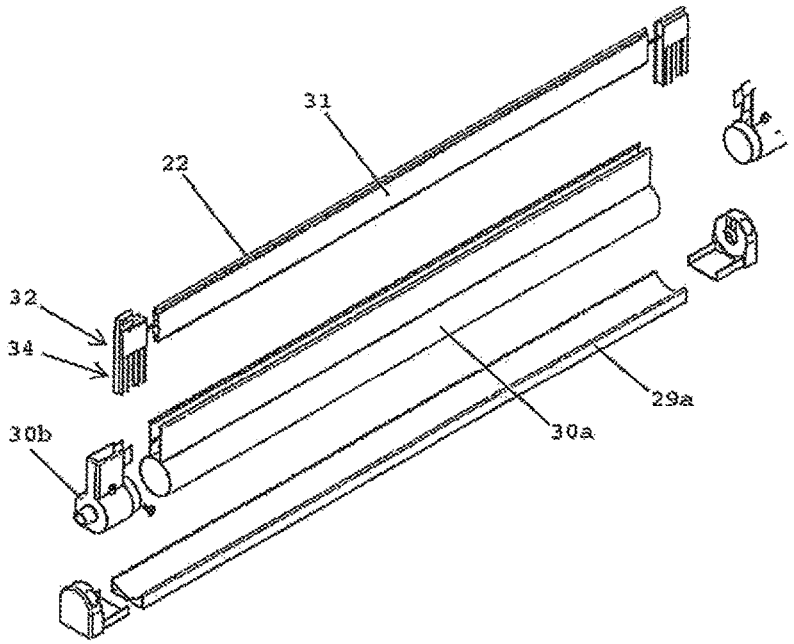
Figure 12B:
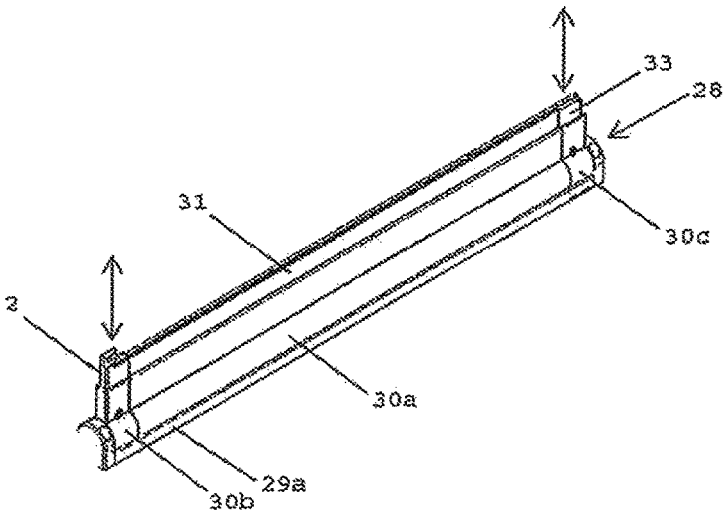
Figure 13:
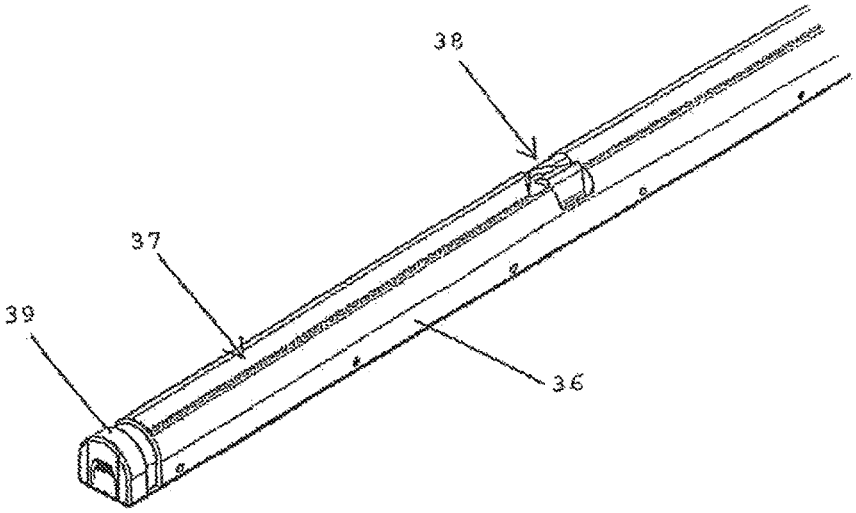
Figure 14:
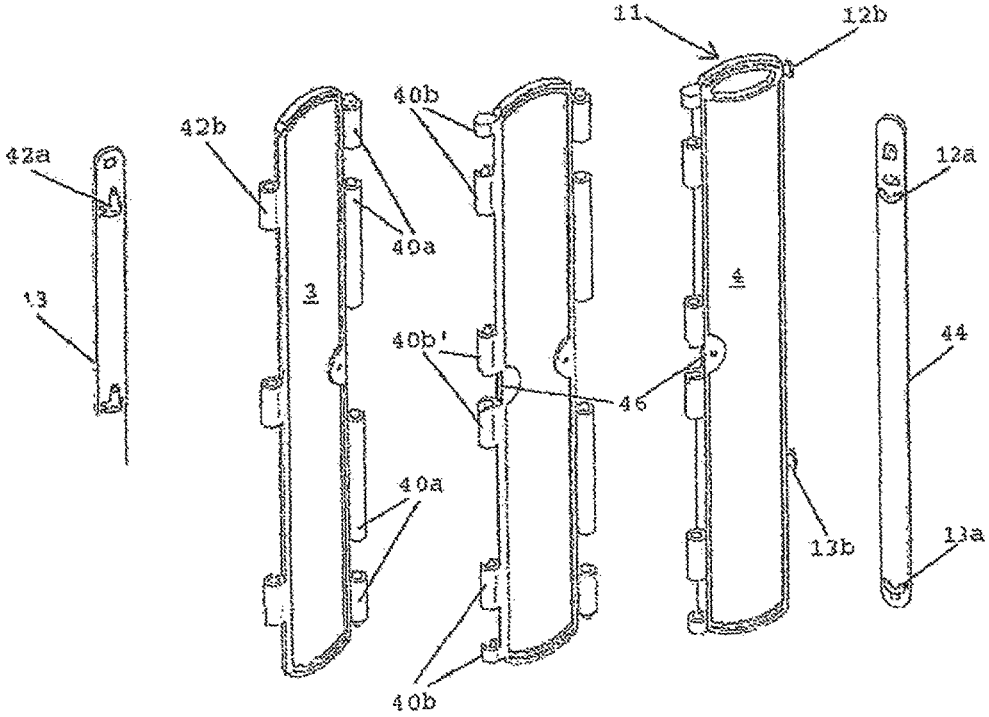
Figure 15A:
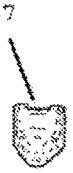
Figure 15B:
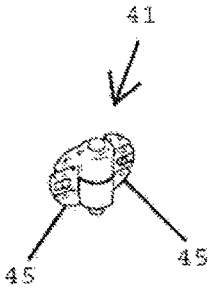
Figure 16:
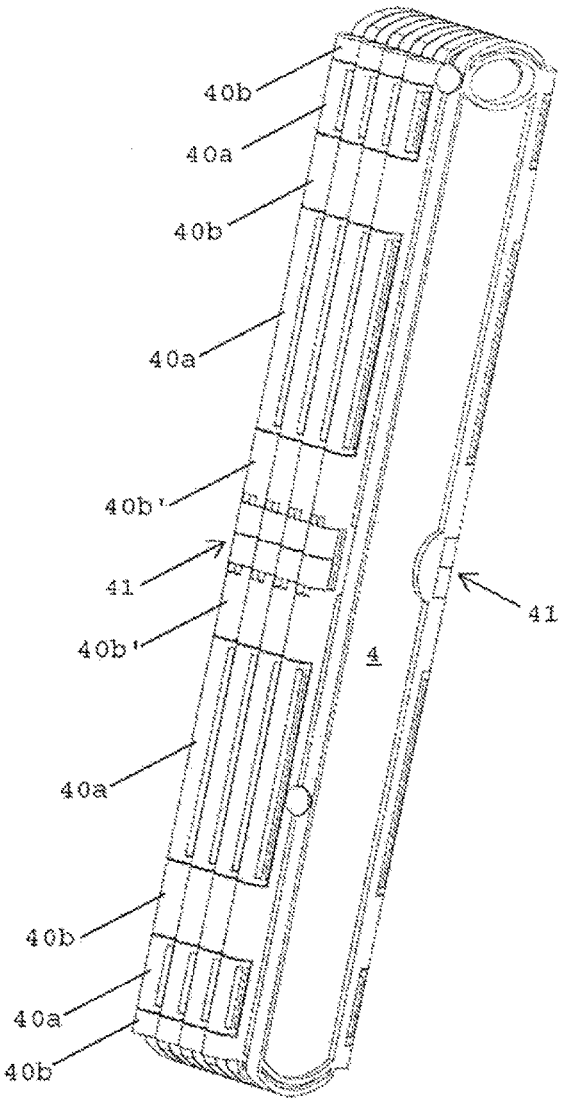

Exemplary embodiments of the invention will be explained more fully below with reference to the drawing, in which FIG. 1 shows a first embodiment of the child safety gate in a closed position, FIG. 2 shows the embodiment of FIG. 1 in an open position, FIG. 3 shows a second embodiment of the panels, FIG. 4 shows a plurality of panels folded inwardly over each other, FIG. 5 shows a rotating hinge connected with the panels, FIG. 6 shows a flexible hinge connected with the panels, FIG. 7 shows a third embodiment of the panels, FIG. 8 shows a fourth embodiment of the panels, FIG. 9 shows an exploded view of an extension panel, FIG. 10 shows a second embodiment of the child safety gate, FIG. 11 shows a third embodiment of the child safety gate, FIGS. 12*a-b* show an exploded and joined view of a fitting with an adjustable end panel, FIG. 13 shows an exemplary embodiment of a closure device, FIG. 14 shows an exploded view of a fourth embodiment of the child safety gate, FIGS. 15*a-b* show a clip and a top part used in the child safety gate shown in FIG. 14, and FIG. 16 shows a joined view of the child safety gate shown in FIG. 14 in an open position.

DESCRIPTION OF THE EXEMPLARY EMBODIMENTS

FIG. 1 shows a first embodiment of the invention mounted on a door frame in a closed position. FIG. 2 shows the invention shown in FIG. 1 in an open position. The invention comprises a child safety gate comprising one or more panels 1, 2, 3, 4, which may be mutual with each other, and which may be mounted in an opening, such as a door opening, a staircase opening, a corridor or passage, an entrance or the like. At least one hinge 5 may be disposed between each of the panels 1, 2, 3, 4, which hinge may be connected with the panel on both sides of the hinge, whereby the panels 1, 2, 3, 4 may be moved relative to each other. The child safety gate comprises two end panels 3, 4 disposed at their respective sides of the gate and a plurality of intermediate panels 1, 2, as shown in FIG. 1. The end panel 3 may be connected with at least one fitting 10, which may be secured to the opening, such as a wall or a frame. The end panel 4 may be connected with at least one closure device 12, 13 and an optional handle 11. Hereby, it is possible to provide a child safety gate which occupies as little space as possible when the gate is open. Moreover, the child safety gate provides a gate which may be mounted in or near an opening independently of any skirting boards, floor mouldings and the like.

The panel 1, 2, 3, 4 may have a solid or hollow structure and have a quadangular, elliptic, circular or any other polygonal or round cross-section. In a second embodiment, the panel structure may comprise two or more panel parts 6, 7, which may be secured to each other by means of friction or fasteners, such as screws, bolts or glue, as shown in FIG. 3. The panel parts 6, 7 may comprise one or more male parts and/or one or more female parts disposed opposite each other, e.g. on the inner side of their respective panel parts. The male part and the female part may be constructed as a pin joint comprising a pin and a pin hole, respectively. The pin joint may comprise a head or an elevation and a corresponding depression or groove, so that the male part and the female part are snapped together. The width and/or the height of the individual panels 1, 2, 3, 4 and the panel parts 6, 7 may be varied, thereby making it possible to adapt the number of panels in the child safety gate to the dimensions of the opening.

A panel top 8 and/or a panel base 9 may be connected with each of the panels 1, 2, 3, 4, as shown in FIGS. 1-2. The panel top 8 and/or the panel base 9 may be constructed as a plug, which may be disposed at the end of the panel 1, 2, 3, 4 or between the panel parts 6, 7 and be secured or held to the panel 1, 2, 3, 4 or the panel parts 6, 7 by means of friction or fasteners. Alternatively, the panel top 8 and/or the panel base 9 may comprise a groove or depression (not shown). in which the panel 1, 2, 3, 4 or the panels parts 6, 7 may be disposed and be secured or held to the panel top 8 and/or the panel base 9 by means of friction or fasteners. The panel top 8 and/or the panel base 9 may be embedded in the ends of the panel 1, 2, 3, 4 or the panel part 6, 7 or form part of the panel 1, 2, 3, 4 itself or the panel part 6, 7 itself. Hereby, it is possible to reinforce and protect the ends of the panel against external blows and impacts.

The panel 1, 2, 3, 4 may be made of plastics, technical plastics, wood, metal or another suitable material. The panel top 8 and the panel base 9 may be made of the same material as the panel itself or another suitable material. The panels 1, 2, 3, 4, the panel tops 8, the panel bases 9 and/or the handle 11 may be made by means of extrusion or moulding (including plastics moulding, injection moulding or full moulding). In a special embodiment, the panel 1, 2, 3, 4, the panel top 8, the panel base 9 and/or the handle 11 may be extruded or moulded in one and the same process, so that they constitute one complete panel or one complete panel part.

The panels 1, 2, 3, 4, the panel tops 8 and/or the panel bases 9 may be made of a transparent, semi-transparent or opaque material. At least one of the panels 1, 2, 3, 4 may be decorated with various colours, figures, patterns, symbols, characters or the like. These decorations may be embossed into at least one of the surfaces of the panel and/or into at least one area on the surface of the panel. Alternatively, at least one of the panels 1, 2, 3, 4 may comprise at least one hole (not shown), which may be shaped decoratively. Hereby, it is possible to decorate the panels or construct the panels so that one can see through them.

The child safety barrier may be mounted at one side of the opening by means of at least one mounting fitting 10, which may be secured to the opening by means of fasteners , such as nails, screws, glue, tape or other types of fasteners. A mounting fitting 10 may be connected with the panel top 8 or the top of the end panel 3, and also another mounting fitting 10 may be connected with the panel base 9 or the base of the end panel 3. Alternatively, the mounting fitting 10 may be constructed as an elongated fitting, where the end panel 3 may be connected with the mounting fitting 10 at one or more points. The mounting fitting 10 may be constructed such that the end panel 3 is capable of rotating to one side or both sides about a first axis of rotation. The mounting fitting 10 comprises a wall part 10*a* intended to be mounted on a firm surface in the opening and a panel part 10*b* intended to be mounted on the end panel 3, the panel top 8 and/or the panel base 9. The panel part 10*b* is configured so as to be capable of rotating about the wall part 10*a* either about a pin in the wall part 10*a*, or a separate pin which connects the wall part 10*a* with the panel part 10*b*. The panel part 10*b* may be secured to the end panel 3, the panel top 8 and/or the panel base 9 by means of fasteners, or be embedded in the end panel 3, the panel top 8 and/or the panel base 9. The mounting fitting 10 may be constructed such that the panel part 10*b* may be displaced vertically between an upper position and a lower position on the wall part 10*a* along the pin.

The end panel 4 or the panel top 8 may comprise an optional handle 11 intended to open and close the gate. The handle may be configured as a conventional handle, as shown in FIG. 1. Alternatively, the handle 11 may be configured as a cut-out or a depression on the panel top 8 or the panel 1, 2, 3, 4. Hereby, a user can easily grip the child safety gate and close or open the gate.

At least one closure device 12, 13 may be mounted at the opposite side of the opening. A first closure device 12 may be connected with the top of the end panel 4 or the panel top 8, as shown in FIG. 1. A second closure device 13 may be connected with the end panel 4 or the panel base 9, as shown in FIG. 1. The closure devices 12, 13 comprise a wall part 12*a*, 13*a* intended to be mounted on a firm surface in the opening, and a panel part 12*b*, 13*b* connected with the end panel 4, the panel top 8 and/or the panel base 9. The panel part 12*b*, 13*b* may be connected with the end plate 4 in the same manner as the panel part 10*b* in the fitting 10 is connected with the end panel 3. The gate is closed in that the panel part 12*b*, 13*b*, such as a pawl, is caused to contact the wall part 12, 13*a*, such as a groove or depression. Hereby, it is possible to prevent children and/or pets from getting through the opening.

The first closure device 12 may comprise a safety mechanism, as shown in FIGS. 1-2, which has to be affected for the gate to be opened. The safety mechanism may comprise a release device, e.g. a pawl with one or more inclined sides connected with a user-operated contact, such as a pushbutton. The pawl may be constructed so as to hold the panel part 12*b* to the wall part 12*a* when the gate is closed. The gate is opened by activating the contact, whereby the pawl is moved away from the panel part 12*b*, following which the panel part 12*b* may be moved away from the wall part 12*a*. The gate is closed by moving the panel part 12*b* across the inclined sides on the pawl and to the wall part 12*a*. Hereby, it is possible to ensure that children and/or pets cannot open the gate.

The hinge 5 may be connected with the panel tops 8, the panel bases 9 and/or the panels 1, 2, 3, 4, as shown in FIGS. 1 and 10-11. One or more hinges 5 may be arranged along the entire edge on the panels 1, 2, 3, 4. The hinge 5 may be disposed in a depression or crack on the edge of the panel top 8, the panel base 9 and/or the panel 1, 2, 3, 4 and may be secured by means of friction or fasteners, such as screws, bolts, glue or other types of fasteners. The hinges 5 may be mounted alternately opposite each other between the panels 1, 2, 3, 4, so that the panels are folded inwardly over each other in a zigzag pattern, as shown in FIG. 4. The hinges 5 may be mounted in the same manner between the panels 1, 2, 3, 4, so that the panels are folded inwardly over each other in a spiral-shaped pattern (not shown). Hereby, it is possible to provide a child safety gate which occupies as little space as possible when the gate is open.

In a first embodiment, the hinge 5 may be constructed as a rotating hinge 14 comprising at least two hinge parts 14*a*, 14*b* capable of rotating about a second axis of rotation, as shown in FIG. 5. The hinge parts 14*a*, 14*b* may be interconnected via a pin disposed in one of the hinge parts, or a separate pin connected with both parts. The hinge 14 may comprise at least one spring, such as a torsional spring (not shown), connected with the hinge parts, so that a certain force has to be applied to the hinge 14 in order to open or close it, following which it will return to its position of rest. Alternatively, the hinge 14 may be constructed as a hinge capable of holding the panels 1, 2, 3, 4 in one or more stop positions along its angle of rotation, such as a frictional hinge or a hinge with at least one stop mechanism. Hereby, it will be possible to provide a child safety gate which may open automatically or may be disposed in a partly open or partly closed position.

In a second embodiment, the hinge 5 may be constructed as a flexible hinge 15 made in a flexible profile or as a flexible membrane, which may be curved, U-shaped or straight, and where the ends may have been made thicker than the rest of the hinge 15, or comprise a head, as in FIGS. 3 and 6. The ends of the flexible hinge 15 may be arranged in a depress ion, such as a groove, in the edge of the panel 1, 2, 3, 4, as shown in FIG. 6. The hinge 15 may comprise at least one spring embedded in the profile of the hinge 15. When the gate is closed, the flexible hinge 15 is loaded, and the hinge 15 will return to its position of rest when the gate is opened because of the spring effect of the hinge 15. Hereby, it is possible to provide a child safety gate which opens automatically.

FIG. 7 shows a cross section of a third embodiment, where the hinge 5 may be embedded in the panels 1, 2, 3, 4. The hinge 5 may be constructed as a rotating hinge 16 comprising a first hinge part 16*a* and a second hinge part 16*b* capable of rotating about the first part 16*a*. The hinge parts 16*a*, 16*b* may be connected with their respective panels 1, 2, 3, 4. FIG. 7 shows the hinge parts 16*a*, 16*b* connected with their respective ends of an intermediate panel 1, 2. The second hinge part 16*b* may be constructed as a hollow or solid ball comprising an outer surface 17 and optionally an inner surface 18. Alternatively, the second hinge part 16*b* may be constructed as a hollow or solid cylinder. The first hinge part 16*a* may be constructed as a ball or cylinder section 19, which may be conformed to the second hinge part 16*b*. The hinge parts 16*a*, 16*b* may be interconnected so that the first hinge part 16*a* is capable of rotating about a central axis in the second hinge part 16*b* along the outer surface 17 and/or the inner surface 18. The second hinge part 16*b* may comprise an elongated opening (not shown), such as a slot, a crack or a groove in which the first hinge part 16*a*, e.g. a pin, may move. The first hinge part 16*a* may comprise either two ball sections/cylinder sections (not shown) or one ball section/cylinder section and one ball/cylinder connected with each other via at least one spacer, between which the second hinge part 16*b* may be disposed. This makes it possible to provide a child safety gate where the hinge forms part of the panel.

The rotating hinge 14, 16 may be made of technical plastics or metal, such as aluminium, copper, steel, iron, bronze, zinc or another suitable material. The rotating hinge 14, 16 may be embedded or encapsulated in the same material as the panel 1, 2, 3, 4. The flexible hinge 15 may be made of technical plastics, rubber, EPDM or another suitable material. The hinge 15, 16 may be made of the same material as the panel 1, 2, 3, 4.

FIG. 8 shows a cross-section of a fourth embodiment, where the hinge 5 may be embedded in the panels 1, 2, 3, 4. The panel 1, 2 may comprise two or more panel parts 20, 21, which may be interconnected via at least one flexible hinge 15. Alternatively, a rotating hinge 14, 16 may be connected with the panel parts 20, 21 instead. The ends of the hinge 15 or the hinge parts 14*a*, 14*b*, 16*a*, 16*b* may be embedded in the panel parts 20, 21.

On the opposite edge of the hinge, the one panel part 20 may comprise a gripping part, e.g. a pin 22, which may have a head 22*a* with a round, triangular, quadrangular or other polygonal shape at the free end. On the opposite edge of the hinge, the other panel part 21 may comprise a receiving part. e.g. a groove 23, in which the pin 22 and the head 22*a* may be arranged. The pin 22 and the groove 23 may be arranged along the entire edge of the panel part 20, 21, so that they form a longitudinal pin and a longitudinal groove, as shown in FIG. 9. Alternatively, two or more pins 22 and grooves 23 may be disposed in extension of each other along the edge, where, at one end or at both ends, the groove 23 may comprise a depression which is wider than the groove, and in which the pin 22 is arranged before the panel parts 20, 21 are joined. The panel parts 20, 21 are joined by placing the pin 22 in the groove 23, following which the pin 22 is displaced up along the groove 23 in the longitudinal direction until the panel parts 20, 21 are disposed opposite each other. The end panel 3, 4 may have the same configuration as the panel 1, 2, where the one panel part 20, 21 may comprise a finishing edge, as shown in FIG. 6, instead of the pin 22 or the groove 23. Alternatively, the end panel 3, 4 may have the same configuration as the one panel part 20, 21, which, instead of being connected with the hinge, comprises a finishing edge, which may be flat or rounded, as shown in FIG. 6. The end panel 3, 4 may have the same width as the one panel part 20, 21, or the same width as the panel parts 20, 21 put together. The mounting fitting 10 and the closure device 12, 13 may be connected with the finishing edge on the end panels 3, 4. Hereby, it is possible to provide a child safety gate which may be joined easily and rapidly.

The panel parts 20, 21 and the hinge 15 may be made in the same extrusion or moulding process, thus making it possible to simplify the joining of the child safety gate. In a special embodiment, the panels 1, 2, 3, 4 and the hinges 15 may be made in one and the same extrusion or moulding process, whereby the child safety gate will appear as one complete gate. Moreover, in the manufacturing process, it is possible to vary the width of the panels 1, 2, 3, 4 and the panel parts 20, 21 and thereby the number of hinges 15.

In an alternative embodiment, instead of being embedded in the panel parts 20, 21, the hinge 15 may be arranged in a groove along the edge of the panel parts, as shown in FIG. 6. The groove in the panel parts 20, 21 and the ends of the hinge 15 may have another shape than the pin 22 and the groove 23, or the same shape. Hereby, the hinge 15 and the panel parts 20, 21 may be joined in the same manner. Further, it is possible to replace either the hinge or one of the panel parts, if this should be necessary.

The panel parts 20, 21 may be connected with their respective panel tops 8 and/or panel bases 9, which may be connected with each other via a rotating hinge 14. The hinge parts 14*a*, 14*b* may be secured to or be embedded in their respective panel tops 8 and/or panel bases 9, as shown in FIGS. 1 and 10. Hereby, the panel parts 20, 21 may rotate about the hinges 14, 15.

FIG. 9 shows an exploded view of an extension panel 24, which may be disposed between the panel parts 20, 21 and/or the end panels 3, 4. The extension panel 24 may have the same shape as the panel part 20, 21 and may comprise a pin and a groove arranged on their respective edges, as shown in FIG. 9. The pin and the groove of the extension panel 24 may have the same shape as the pin 22 (with a head 22*a*) and the groove 23 on the panel part 20, 21. The extension panel 24 may have the same width as the panel parts 20, 21, or a width which is either larger or smaller than the panel parts 20, 21. The extension panel 24 may be connected with the panel parts 20, 21 in the same manner as the panel parts 20, 21 are joined. Hereby, it is possible to adapt the width of one or more panels 1, 2, 3, 4 and the entire child safety gate by introducing one or more extension panels 24.

In a special embodiment (not shown), the hinges 5 may be omitted, and a plurality of extension panels 24 and optionally panel parts 20, 21 are connected with each other as well as the end panels 3, 4, so that, together, they form a complete rigid child safety gate. Hereby, it is possible to produce a child safety gate which is easy and rapid to join in the desired width and is simple and inexpensive to produce.

A panel base 25 and/or a panel top 26 may be connected with the extension panel 24. The panel base 25 and/or the panel top 26 may be connected with the extension panel 24 by means of friction or fasteners, such as screws, bolts, glue or another fastener (not shown). The panel base 25 and the panel top 26 may have the same shape as the panel base 8 and the panel top 9, or the panel base 8, 25 may have the same shape as the panel top 9, 26.

In a preferred embodiment, the panel base 8, 25 and/or the panel top 9, 26 may comprise an insertion part 25*a*, 26*a* disposed in extension of the panel 24 and a receiving part 25*b*, 26*b* which may be disposed at the side of the insertion part, and where the opening faces toward the pin 22 or the groove 23 (opposite the insertion part), as shown in FIG. 9. The insertion part 25*a*, 26*a* may be configured to engage another receiving part 25*b*, 26*b* disposed on another panel 24, or vice versa. The receiving parts 25*b*, 26*b* may be disposed on their respective sides of the panel 24, as shown in FIG. 9. The insertion part 25*a*, 26*a* and the receiving part 25*b*, 26*b* may be configured as a pin arrangement and a pin hole arrangement, respectively. The panel base 25 and the panel top 26 may have a pin 22' and a groove 23' disposed in extension of the pin 22 and the groove 23 on the extension panel 24, as shown in FIG. 9, intended to guide the insertion part 26*a* into the receiving part 26*b*, when the panels are joined. Hereby, the panel base and the panel top will appear as one complete unit when the panel parts 20, 21, 24 are joined. Moreover, it is possible to adapt the width of the panel top and the panel base to the width of the panels 1, 2, 3, 4, when one or more extension panels 24 are inserted.

The insertion part 25*a*, 26*a* on the panel base 25 and/or the panel top 26 may comprise a locking device 27 intended to engage the receiving part 25*b*, 26*b*, e.g. a hole. The locking device 27 may comprise a release mechanism, which is activated before the panels are separated. Hereby, the panels 1, 2, 3, 4, 24 may be held to each other when the child safety gate is used.

The child safety gate may be operated by one hand, whereby the gate may be opened and closed easily and rapidly. The gate is closed by gripping the handle 11 and pulling the end panel 4 and the intermediate panels 1, 2 toward the closure devices 12, 13. Then, the gate is lifted optionally briefly upwards to cause the panel parts 12*b*, 13*b* to contact the wall parts 12*a*, 13*a*, as shown in FIG. 1. The gate is opened by gripping the handle 11 and activating the contact on the safety mechanism by one finger. Then, the gate is lifted optionally briefly upwards to separate the panel parts 12*b*, 13*b* from the wall parts 12*a*, 13*a*, following which the end panel 4 is moved toward the fitting 10, whereby the panels 1, 2, 3, 4 will fold inwardly over each other. Alternatively, the handle 11 is released after the gate has been opened, whereby the spring force in the hinges 14, 15 will automatically fold the panels 1, 2, 3, 4 together.

A tightening mechanism (not shown) may be disposed inside the panels 1, 2, 3, 4 or in the panel top 8 and/or the panel base 9, which is capable of tightening the panels when the gate is closed, whereby the panels 1, 2, 3, 4 will form a relatively straight line. Hereby, it is possible to prevent children and/or pets from getting through the opening, and from getting their fingers and/or paws caught between the panels.

The distance between the end panels 3, 4 and/or the intermediate panels 1, 2 may be determined by the panel top 8, the panel base 9 and/or the hinges 14, 15, 16. FIG. 10 shows a second embodiment of the child safety gate, where the panels 1, 2, 3, 4 are interconnected via one or more flexible hinges 15. The hinges 15 occupy the space between the panels 1, 2, 3, 4, so that a child and/or pet cannot get their fingers and/or paws caught between the panels. The panels 1, 2, 3, 4 may comprise one or more areas 1*a*, 2*a*, 3*a*, 4*a* in the centre of the sides, which may have a concave or convex surface, and which may be elongated, round, quadrangular or have any other shape. FIG. 11 shows a third embodiment of the child safety gate, where the panel tops 8 and the panel bases 9 are interconnected via a plurality of rotating hinges 14, and where the panels 1, 2, 3, 4 are arranged with a suitable distance between each other, thereby minimizing the risk of a child and/or pet getting their fingers and/or paws caught between the panels.

FIG. 12*a* shows an exploded view of an adjustable mounting fitting 28, which may be connected with the panels 1, 2, 4. The mounting fitting 28 comprises an elongated wall part 29 connected with a panel part 30, which is capable of rotating about an axis of rotation in the wall part 29. The wall part 29 may comprise a central member 29*a* connected with two end members extending perpendicularly from the central member. The panel part 30 may be disposed between the end members on the wall part 29 and may be rotatably connected with the end members, e.g. via a pin and a depression disposed on the wall part 29 and the panel part 30, respectively, or vice versa. The panel part 30 may comprise a central member 30*a* connected with two end members 30*b*, 30*c*, on which the pins/depressions may be disposed. The central member 30*a* may be configured as a hollow or solid cylinder, which may have the same length as the panels 1, 2, 3, 4. The central member 29*a* may comprise a groove, e.g. a cylinder section, on which the cylinder is disposed. Hereby, it is possible to provide a fitting where the risk of children and/or pets getting their fingers/paws caught in the fitting when the child safety gate is opened or closed, is reduced considerably.

Two parallel sides facing away from the wall part 29 may be disposed on the outer side of the cylinder, as shown in FIG. 12*a*. The end members 30*b*, 30*c* may be configured as a top member and a base member, respectively, which may have the same shape as the central member 30*a*. A U-shaped side may be disposed on the outer side of the end members 30*b*, 30*c* in extension of the parallel sides of the central member 30*a*, as shown in FIG. 12*a*, so that the parallel sides together with the Li-shaped sides form a delimited channel in which an adjustable end panel 31 may be disposed and partly concealed, as shown in FIG. 12*b*. The end panel 31 may have the same shape as one of the panel parts 20, 21, the extension panel 24 or the end panel 3. The end panel 31 may have the same width as the end panel 3, the extension panel 24 or the panel part 20, 21. A panel top 32 and/or a panel base 33 may be connected with the end panel 31 by means of friction or fasteners, such as screws, bolts, internal toothed member, adhesive or another fastener. At one end, the panel 32 and/or the panel base 33 may comprise a guide arrangement 34, which faces toward the panel part 30, and which is capable of engaging the end member 30*b*, 30*c*, as shown in FIGS. 12*a-b*. The end member 30*b*, 30*c* may comprise a locking mechanism, e.g. a screw, a bolt or a toothed member, which is capable of holding the guide arrangement 34 and thereby the end panel 31 in a given position (indicated by the arrows). Hereby, it is possible to provide a mounting fitting suitable for oblique/inclined openings, where the position of the end panel relative to the mounting fitting may be adjusted individually at the top and at the bottom, thereby achieving correct mounting. Moreover, it is possible to prevent children and/or pets from getting their fingers/paws caught between the end panel and the fitting.

On the edge facing away from the panel part 30, the end panel 31 may comprise a pin or a groove which may have the same shape as the pin 22 or the groove 23. At the opposite end of the guide arrangement 34, the panel top 32 and/or the panel base 33 may have the same shape as the insertion part 25*a*, 26*a*, or comprise a receiving part which faces away from the guide arrangement 34, and which may have the same shape as the receiving part 25*b*, 26*b*. The insertion part on the end panel 31 may like-wise comprise the locking device 27. Hereby, it is possible to connect the end panel 31 with the panels 1, 2, 4, 24 in the same manner as the panel parts 20, 21.

FIG. 13 shows an exemplary embodiment of a closure device 35, which may be connected with the end panel 4. The closure device 35 may be configured as an elongated fitting comprising a wall part (not shown) connected with a surrounding housing 36. The housing 36 may be connected with the wall part by means of friction or fasteners, such as screw, bolts, glue or another fastener. The housing 36 comprises an elongated depression 37, in which the end panel 4 may be disposed and secured. A locking arrangement may be arranged inside the housing, intended to hold the end panel 4 in the housing 36 when the child safety gate is closed. The locking arrangement may comprise a release device which may be activated by a user, following which the end panel 4 may be removed from the housing 36, and the child safety gate is opened. Hereby, it is possible to provide a closure device, where children and/or pets cannot get their fingers/paws caught between the end panel and the closure device.

In a preferred embodiment, a mechanical locking arrangement, which is released mechanically by the user, may be disposed in the housing 36. Two or more gripping elements 38 may be disposed in an opening in the housing 36, e.g. in a depression 37, intended to grip the end panel 4, e.g. a depression or an elevation as shown in FIG. 13. The gripping elements 38 may be interconnected via a spring, e.g. a torsional spring (not shown), which presses the gripping elements toward each other in an unloaded state. A release 39 may be connected with the gripping elements 38 via a spacer (not shown), which presses the gripping elements 38 away from each other when the release 39 is activated, e.g. is moved toward the gripping elements 38. Then, the end panel 4 may be removed from the housing 36. The child safety gate is closed either by moving the end panel 4 into the housing while the release 39 is activated, following which the release 39 is released, or by moving the end panel 4 directly into the housing 36, whereby the gripping elements 38 automatically grip the end panel 4.

FIG. 14 shows an exploded view of a fourth embodiment of the child safety gate. FIG. 16 shows an assembed view of the child safety gate shown in FIG. 14 in an open position, where the panels are folded inwardly over each other. The panels 1, 2, 3, 4 may be interconnected by means of two or more hinges 5, which may be connected with the edge of the panel in the longitudinal direction. The hinges 5 may be constructed as a plurality of rotating hinges 40, which may comprise a plurality of hinge parts 40*a*, 40*b* connected with their respective panels which are capable of rotating abut a pin disposed on one of the hinge parts 40*a*, 40*b*, as shown in FIG. 14. The hinge parts 40*a*, 40*b* may be embedded in the panels 1, 2, 3, 4. At one end, the hinge parts 40*b* may comprise a first cut-out, which may have the same shape as the pin on the other hinge part 40*a*, thereby making it possible to move the hinge part 40*a* into the hinge part 40*b* via the cut-out. At the opposite end, two or more of the hinge parts 40*b*' may comprise a second cut-out, which may have the same shape as a pin disposed at both ends of a clip 41.

At the opposite side of the hinge 40, the end panel 3 may comprise one or more panel parts 42*b*, which are capable of rotating about at least one pin disposed on one or more wall parts 42*a* on the fitting 43. At the opposite side of the hinge 40, the end panel 4 may comprise at least one panel part 12*b*, 13*b*, which may be caused to contact at least one wall part 12*a*, 13*a* on the fitting 44. The panel parts 12*b*, 13*b* and/or the wall parts 12*a*, 13*a* may be embedded in the end panels 3, 4.

The clip 41 shown in FIG. 15*b* may comprise two halves, which, at one end, may have the same shape as the hinge part 40*a* and the hinge part 40*b*, respectively, whereby the two halves may rotate about each other. The other end may be shaped as a plate 45, which is moved into a crack 46 on the panel 1, 2, 3, 4. The clip 41 may be secured to the panels 1, 2, 3, 4 by means of fasteners or by means of a snap system. The clip 41 comprises a spring (not shown) connected with both halves, which presses the halves against each other in an unloaded state. Hereby, it is possible to hold the panels to each other, so that there is a minimal risk of getting the fingers and/or the paws caught between the panels. Likewise, the spring disposed in the clip will ensure that the panels automatically fold together.

A top 47, as shown in FIG. 15*a*, may be arranged on the wall parts 42*a* after the end panel 3 has been mounted on the fitting 43. The base of the top 47 may comprise a depression which is moved down over the uppermost part of the pin on the wall part 42*a*. The top 47 may be secured to the fitting 43 by means of fasteners or by means of a snap system, e.g. a movable pawl, which may be connected with an optional spring. Hereby, it is possible to prevent the end panel from being lifted off the fitting in normal use.

Each of the mentioned alternative embodiments may be combined with the preferred embodiment.

The invention claimed is:

1. A child safety gate kit comprising kit parts, wherein a child safety gate assembled from the kit parts is mountable in a door or staircase opening, the child safety gate kit parts comprising:

a plurality of panels, a mounting fitting mountable at one side of the door or staircase opening, and a closure device mountable at an opposite side of the door or staircase opening, wherein one panel of the plurality of panels is a mounting end panel capable of rotating about a first axis of rotation in the mounting fitting when mounted on the one side of the door or staircase opening, each of at least two panels of the plurality of panels is connectable to a receiving part of an adjacent panel via a gripping part disposed on one side of the panel and to a gripping part of another adjacent panel via a receiving part (23) disposed on the other side of the panel, wherein said each of at least two panels of the plurality of panels comprises two panel parts (20, 21), said gripping part arranged on a first panel part (20), said receiving part (23) arranged on a second panel part (21) and wherein the two panel parts (20, 21) are joined with a flexible hinge (15), extruded or embedded in the two panel parts (20, 21), wherein one panel of the plurality of panels is a closure-end panel for connection to the closure device when mounted at the opposite side of the door or staircase opening, and wherein at least one of both tops or bottoms of the two panel parts (20, 21) are connected with each other via a rotating hinge (14) comprising at least one spring whereby the two panel parts (20, 21) are rotatable about the flexible hinge (15) and the rotating hinge (14).

2. The child safety gate kit according to claim 1, wherein the gripping part is configured as a pin (22) extending from the first panel part (20) to a head (22*a*) end of the gripping part, the head end having a round, triangular, quadrangular or other polygonal shape; and wherein the receiving part (23) is configured as a groove (23) to engage a gripping part (22) of an adjacent panel.

3. The child safety gate kit according to claim 2, wherein the gripping part (22, 22*a*) extends along an entire edge of the first panel part (20) and the groove (23) extends along an entire edge of the second panel part (21), so that they form a longitudinal gripping part (22, 22*a*) and a longitudinal groove (23).

4. The child safety gate kit according to claim 3, wherein the longitudinal gripping part (22, 22*a*) first panel part (20) of the at least one panel is joined to the receiving part of the adjacent panel by placing the longitudinal gripping part (22, 22*a*) of the first panel part in the longitudinal groove (23) of the second panel part of the adjacent panel, and the longitudinal gripping part is then displaced up along the longitudinal groove (23) until the first panel part (20) of the at least one panel is disposed opposite the second panel part (23) of the adjacent panel so that the at least one panel is adjoined to the adjacent panel.

5. The child safety gate kit according to claim 1, further comprising one or more extension panels, said extension panels configured for assembly between a panel part and an end panel.

6. The child safety gate kit according to claim 2, further comprising one or more extension panels (24), each extension panel (24) having a same shape as of the two panel parts (20, 21) without any flexible hinge and comprises a pin (22) and a groove (23) arranged on respective edges thereof; wherein the pin (22) and the groove (23) of said each extension panel (24) has the same shape as the pin (22) with head (22*a*) and the groove (23) on the two panel parts (20, 21).

7. The child safety gate kit according to claim 6, wherein a panel base (25), or a panel top (26), or a panel base (25) and a panel top (26), are connected with said each extension panel (24), wherein the panel base (25), or the panel top (26), or the panel base (25) and the panel top (26) comprise a respective base or top insertion part (25*a*, 26*a*) disposed in extension of the extension panel (24), and a respective base or top receiving part (25*b*, 26*b*), which is disposed at a side of the insertion part (25*a*, 26*a*).

8. The child safety gate kit according to claim 7, wherein the respective base or top insertion part (25*a*, 26*a*) is configured to engage another respective base or top receiving part (25*b*, 26*b*) disposed on another extension panel (24) or a panel part (20, 21).

9. The child safety gate kit according to claim 7, wherein the respective base or top receiving part (25*b*, 26*b*) is disposed on a respective base or top of the extension panel (24).

10. The child safety gate kit according to claim 7, wherein the respective base or top insertion part (25*a*, 26*a*) and the respective base or top receiving part (25*b*, 26*b*) are configured as a pin arrangement and a pin hole arrangement, respectively.

11. The child safety gate kit according to claim 7 wherein the panel base (25) and the panel top (26) comprise a pin (22') and a groove (23') disposed in extension of the pin (22) and the groove (23) on the extension panel (24), so as to guide the insertion part (26*a*) into the receiving part (26*b*), when the panels are joined.

12. A child safety gate kit, wherein a child safety gate assembled from the kit is mountable in a door or staircase opening, the child safety gate kit comprising:

a mounting fitting mountable on a first side of the opening;

a mounting-end panel for mounting onto the mounting fitting and capable of rotating about a first axis of rotation in the mounting fitting when mounted at the first side of the opening;

a closure device mountable on a second, opposite side of the opening;

a closure-end panel connectable to the closure device; and a plurality of intermediate panels separated from the mounting end panel and the closure-end panel prior to installation of the child safety gate in the opening, each of the plurality of intermediate panels connected to at least one other intermediate panel when the child safety gate is installed in the opening, each intermediate panel of the plurality of intermediate panels having a first panel part with a gripping part and a second panel part with a receiving part, the first panel part and the second panel part separated by a flexible hinge so that when installed, the plurality of intermediate panels form an assembly of intermediate panels connected between the mounting-end panel on the first side of the opening and the closure-end panel on the second, opposite side of the opening, and a gripping part or a receiving part of a first end of the assembly of intermediate panels is connected to a respective receiving part or gripping part of the mounting end panel and a receiving part or a gripping part of the second end of the assembly of intermediate panels is connected to a respective gripping part or receiving part of the closure-end panel, wherein in an opened condition of the child safety gate, each intermediate panel is foldable about the flexible hinge so that the first panel part and the second panel part lie alongside one another and the intermediate panels are folded up and the door or staircase opening is opened, and wherein in a closed condition of the child safety gate, each intermediate panel is unfoldable about the flexible hinge so that the first panel part and the second panel part are unfolded from one another and the door or staircase opening is closed, and wherein at least one of tops or bottoms of the two panel parts (20, 21) are connected with each other via a rotating hinge (14) comprising at least one spring whereby the two panel parts (20, 21) are rotatable about the flexible hinge (15) and the rotating hinge (14) so that the panels are automatically folded inwardly over each other from the closed condition into the opened condition when the closure-end panel is disconnected from the closure device.

* * * * *